United States Patent [19]

Fayard

[11] Patent Number: 4,977,869

[45] Date of Patent: Dec. 18, 1990

[54] VALVE ASSEMBLY FOR INTERNAL-COMBUSTION ENGINES

[75] Inventor: Jean-Claude Fayard, Lyons, France

[73] Assignee: ELF France, Courbevoie, France

[21] Appl. No.: 478,944

[22] Filed: Feb. 12, 1990

[30] Foreign Application Priority Data

Feb. 17, 1989 [FR] France ..... 89 02127

[51] Int. Cl.[5] ..... F01L 3/00

[52] U.S. Cl. ..... 123/188 S; 123/90.24; 123/188 SB

[58] Field of Search ..... 123/188 S, 188 SB, 188 R, 123/188 SC, 90.24, 90.25, 90.26, 84, 85, 86

[56] References Cited

U.S. PATENT DOCUMENTS 2,424,738 7/1947 Bronander ..... 123/188 S
3,168,083 2/1965 Buchanan ..... 123/85
3,289,658 12/1966 Surovek, Sr. ..... 123/90.24

FOREIGN PATENT DOCUMENTS 2518166 6/1983 France ..... 123/90.25

*Primary Examiner*—E. Rollins Cross
*Attorney, Agent, or Firm*—Oblon, Spivak, McClelland, Maier & Neustadt

[57] ABSTRACT

Valve assembly (22) intended for closing a combustion chamber (14) of an internal-combustion engine and comprising a valve (36) and a valve seat (42), the valve lifting off from its seat in order to open the combustion chamber (14) by moving away from the latter.

According to the invention, the valve seat (42) is designed to move relative to the combustion chamber (14) under the effect of the pressure prevailing in this chamber and thereby to reinforce the closing of the valve assembly.

6 Claims, 3 Drawing Sheets

FIG_4
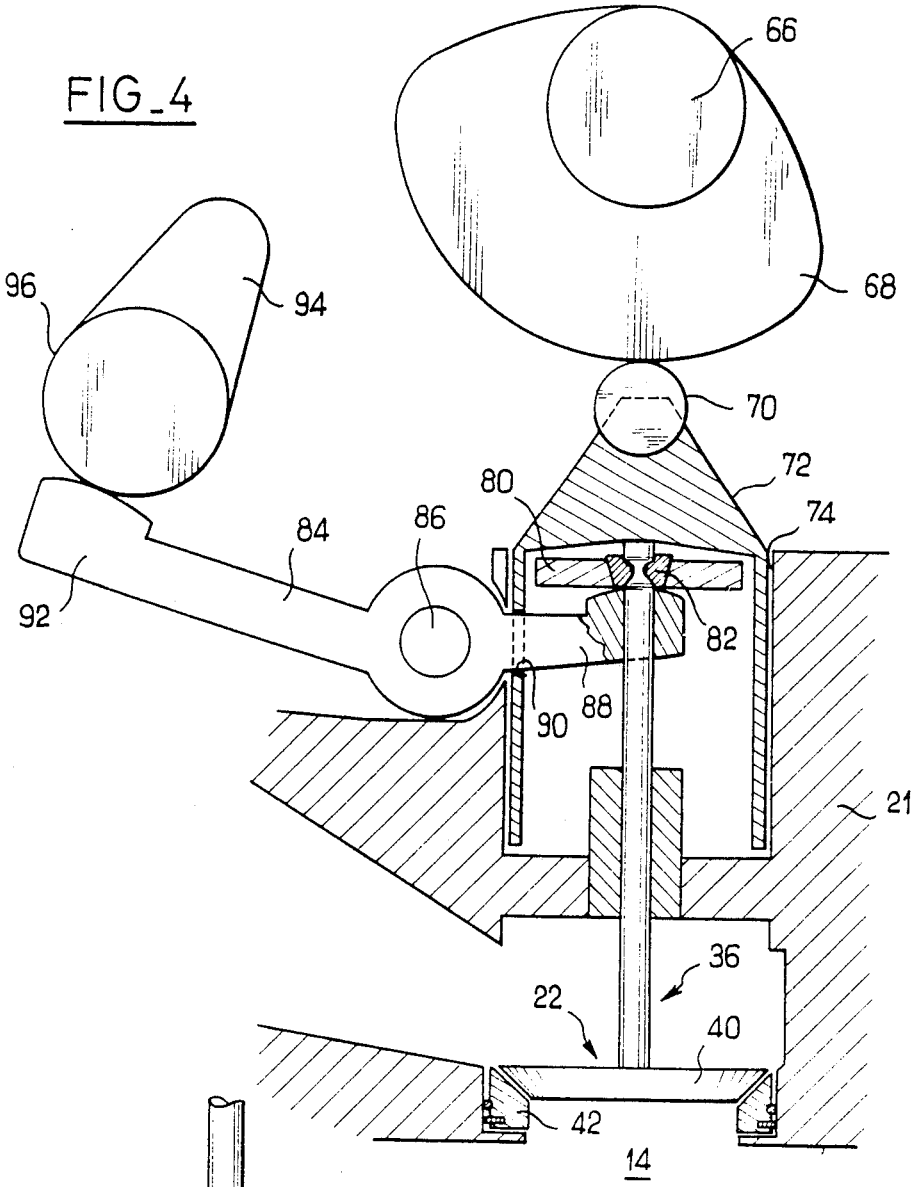
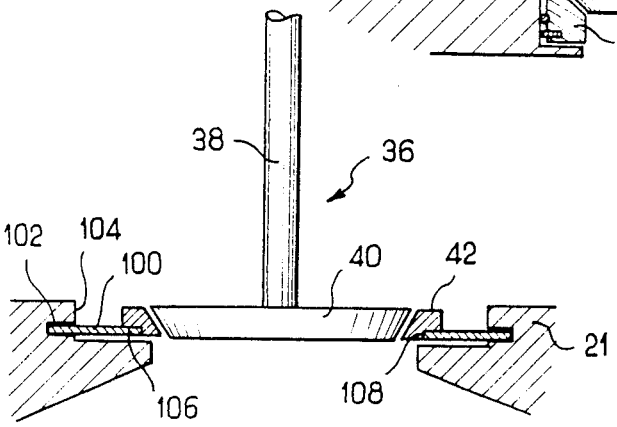
FIG_5

VALVE ASSEMBLY FOR INTERNAL-COMBUSTION ENGINES

The present invention relates to a valve assembly for internal-combustion engines and, more particularly, to a valve assembly intended for controlling the passage of gas to or from a combustion chamber of an internal-combustion engine In a four-stroke internal-combustion engine of conventional construction, the valves mounted at the intake or at the exhaust are arranged in such a way that, during the opening of the valve, the valve head enters the combustion chamber of the engine. This arrangement, although allowing the engine to function correctly, has the disadvantage that the upper surface of the pistons of the engine have to be given a substantially concave zone so as to avoid any inopportune contact between the piston and the valve. The presence of this concave zone can have harmful effects on the combustion of the fuel/air mixture in the combustion chamber.

The document FR-A-2,518,166 describes a valve assembly for an internal-combustion engine which opens by moving away from the combustion chamber This valve assembly has disadvantages because the pressure generated in the combustion chamber during the explosion acts on the valve and tends to lift it off from its seat. The sealing of the combustion chamber is therefore not guaranteed.

The object of the present invention is to provide a valve assembly for an internal-combustion engine, which is reliable and of simple construction and the sealing of which is ensured when the assembly is closed.

To achieve this, the invention provides a valve assembly intended for closing a combustion chamber of an internal-combustion engine and comprising a valve and a valve seat, the valve lifting off from its seat in order to open the combustion chamber by moving away from the latter, characterized in that the valve seat is designed to move relative to the combustion chamber under the effect of the pressure prevailing in this chamber and thereby to reinforce the closing of the valve assembly.

Other characteristics and advantages of the invention will emerge from the description which follows, given by way of example, with reference to the accompanying drawings in which.

FIG. *3a* is a view in longitudinal section of a valve assembly according to the invention, with which a first type of actuating means is associated;

FIG. *3b* is a view taken according to the arrows—3—of FIG. *3a;*

Figure 1:
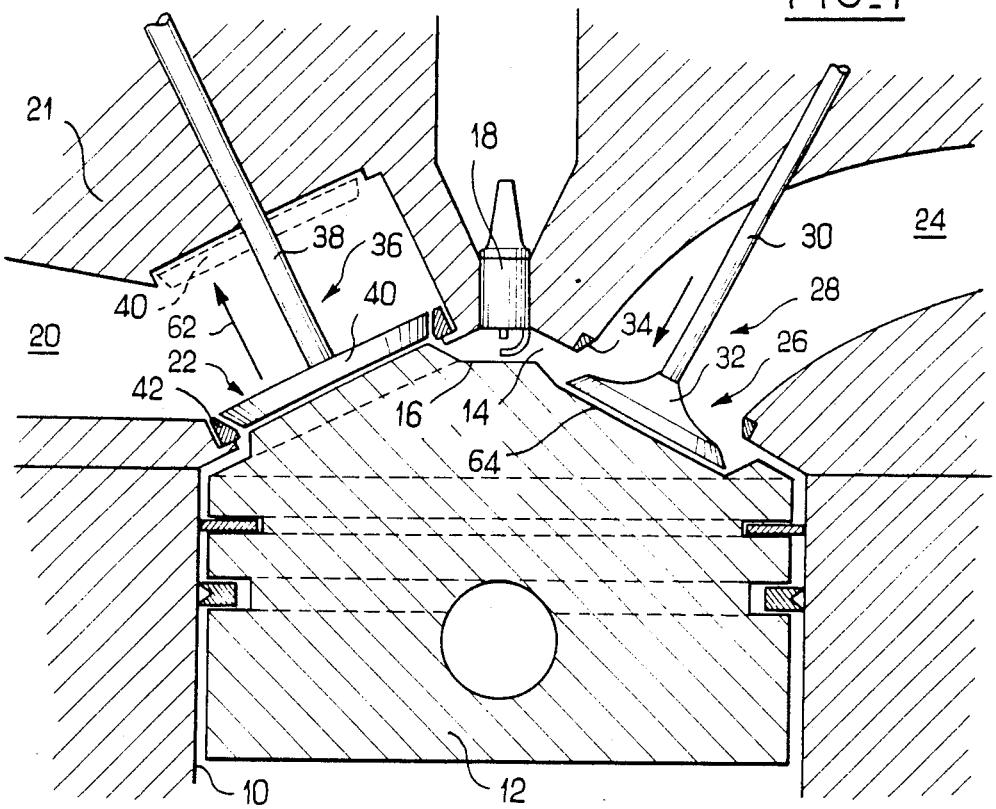
FIG. 1 is a view in longitudinal section of part of an internal-combustion engine having a valve assembly according to the invention.

FIG. 4 is a view in longitudinal section of a valve assembly according to the invention, with which a second type of actuating means is associated; and FIG. 5 is a diagrammatic view of a valve assembly according to another embodiment FIG. 1 illustrates part of an internal-combustion engine comprising a cylinder 10, in which a piston 12 slides. A combustion chamber 14 of variable volume is defined between the upper surface 16 of the piston 12 and the cylinder 10 and has a spark plug 18. The combustion chamber 14 is connected to a source of a fuel/air mixture, such as a carburettor (not shown), by means of a passage 20 which is formed in the cylinder head 21 of the engine and in which is arranged a valve assembly 22 which will be described in more detail below.

The combustion chamber 14 is also connected to the ambient air by means of an exhaust passage 24, in which a valve assembly 26 of conventional construction is arranged. The valve assembly 26 comprises a valve element 28 formed from a stem 30 and from a valve head 32 which is intended for interacting with a seat 34 under the effect of a spring (not shown) in order to close the passage 24. During the opening of the valve, the valve element 28 is moved towards the inside of the combustion chamber 14, in the direction of the arrow, under the effect of an actuating means, such as a cam shaft (not shown).

Figure 2:
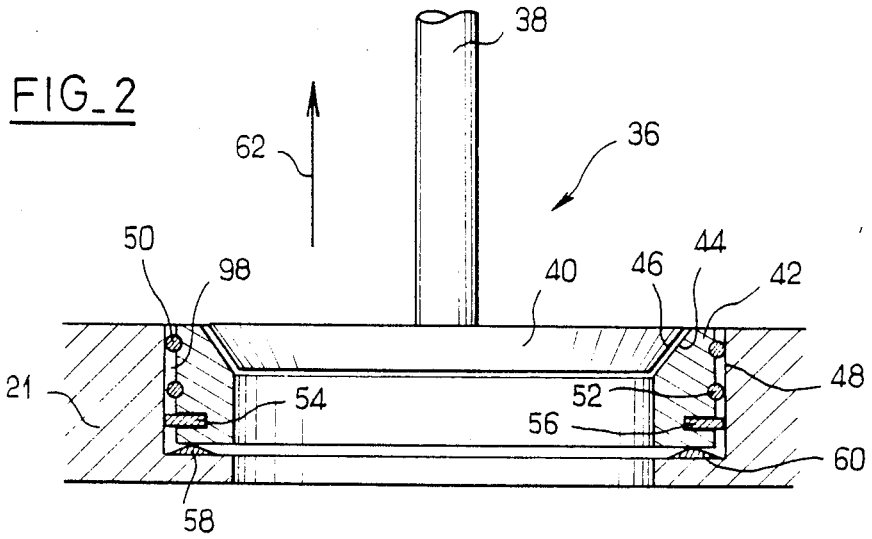
FIG. 2 is a detailed diagrammatic view of the valve assembly of FIG. 1.

The valve assembly 22 comprises a valve element 36 formed from a stem 38 and from a valve head 40. According to the invention, the valve assembly 22 comprises, furthermore, a seat 42 mounted movably relative to the cylinder head 21. As shown in FIG. 2, the seat 42 is a substantially annular piece which is made of metal, for example steel, or of a sintered material. The seat 42 has a chamfered surface 44 intended for interacting sealingly with a corresponding surface 46 formed on the head 40 of the valve element 36. The seat 42 is mounted sealingly slidably in a stepped bore 48 made in the cylinder head 21 and having a bearing surface 60. The sealing between the seat 42 and the bore 48 is ensured by means of two O-ring gaskets 50 and 52, each received in an annular groove formed on the periphery of the seat 42. Moreover, the seat 42 has a substantially annular metal segment 54 which is received in a slot 56 likewise made in the periphery of the seat and which thus ensures sealing between the seat 42 and the stepped bore 48. An annular washer 58 is arranged on the bearing surface 60 of the stepped bore 48 and serves for ensuring a slight clearance between the seat 42 and the bearing surface 60.

The opening of the valve element 36 takes place in the direction of the arrow 62, the valve head 40 moving away from the combustion chamber 14. When the valve element 36 is in the open position, the valve head 40 occupies the position represented by broken lines. During the closing of the valve assembly 22, the valve element 36 moves in the opposite direction to the arrow 62 under the effect of the cam shaft, and the valve head 40 comes into abutment with the seat 42. According to the invention, the seat 42 serves for reinforcing the closing of the valve assembly 22 during the ignition of the mixture in the chamber 14. The pressure generated in the combustion chamber 14 acts on the annular cross-section of the seat 42 and tends to move it in the stepped bore 48 towards the valve head 40 in the direction of the arrow 62. The sealing between the two chamfered surfaces 44 and 46 is thereby ensured.

The fact that the valve assembly 22 opens in such a way that the valve head 40 moves away from the combustion chamber 14 affords some advantages in relation to a valve assembly of conventional construction. The opening of the valve assembly 28 towards the inside of the combustion chamber 14 makes it necessary for the upper surface 16 of the piston 12 to have a substantially concave zone 64, in order to avoid any inopportune contact between the valve head 32 and the upper surface 16 of the piston 12. The presence of this concave zone 64 can have harmful effects on the combustion of the fuel/air mixture in the combustion chamber 14. In contrast, with the valve assembly 22 according to the invention, the valve head 40 never enters the combustion chamber, and the upper surface 16 of the piston can therefore be formed in such a way as to achieve the most efficient possible combustion.

Figure 3A:
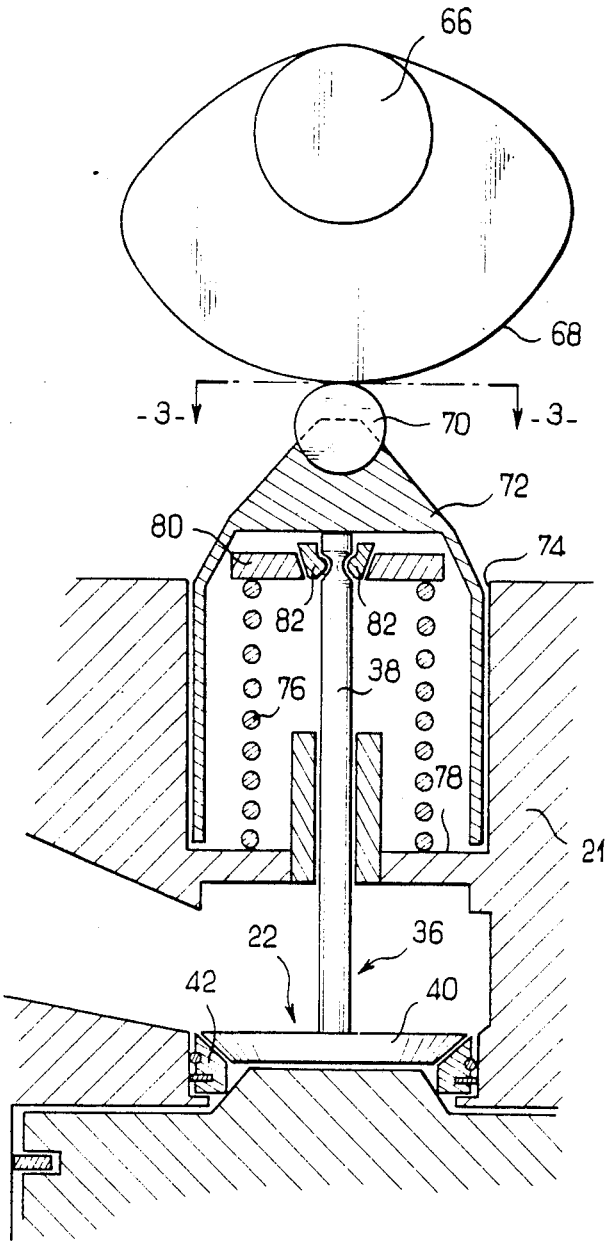
Figure 3B:
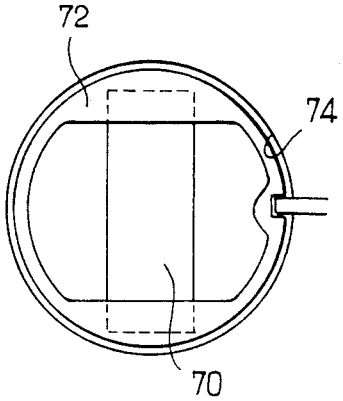

FIG. 3 illustrates a first type of actuating means for the valve assembly according to the invention A cam shaft 66 has several cam surfaces 68, each intended for interacting with a valve assembly. The cam surface 68 interacts with the end of the stem 38 of the valve element 36 by means of a roller 70 mounted freely in terms of rotation in a cage 72. The cage 72 of substantially cylindrical form is received round the stem 38 in a cylindrical receptacle 74 made in the cylinder head 21. A compression spring 76 is arranged round the stem 38 and is retained between the bottom 78 of the receptacle 74 and an annular collar 80 mounted fixedly on the stem 38 by means of two collet chucks 82. The spring 76 thus tends to open the valve assembly 22. The closing of the valve assembly 22 takes place as a result of the action of the cam surface 68 which acts on the valve stem 38 by means of the roller 70. During the explosion, the closing of the valve assembly 22 is reinforced by the seat 42 which tends to move towards the valve head 40.

A second type of actuating means for the valve assembly 22 is illustrated in FIG. 4. In this embodiment, the closing of the valve assembly takes place in a substantially similar way to that of FIG. *3a*. The actuating means comprises a lever 84 mounted tiltably on an axle 86 fastened to the cylinder head 21. The lever 84 has one end 88 which is fork-shaped and which passes through an orifice 90 into the cage 72 and bears on the lower face of the annular collar 80. The other end 92 of the lever 84 is intended for interacting with a cam surface 94 of a cam shaft 96. The closing of the valve assembly 22 takes place in the same way as in the embodiment of FIG. *3a*.

It is possible for the actuating means to be modified so that the cam surface 68 acts directly on the end of the stem 38 of the valve.

A second type of mounting of the seat 42 in the cylinder head 21 is illustrated in FIG. 5. The seat 42 is mounted in the bore 48 by means of a flexible steel washer 100, the periphery of which is received sealingly in a slot 102 made in the wall 104 of the bore 48. The inner edge 106 of the washer 100 bears sealingly on a bearing surface 108 formed on the seat 42. The seat 42 is thus mounted sealingly relative to the cylinder head 21, but it is free to move slightly under the effect of the pressure in the combustion chamber 14, so as to reinforce the closing of the valve assembly 22.

It is possible for the washer 100 to be replaced by a metal concertina.

To ensure the cooling of the seat 42, it is possible to cause oil to circulate in the annular space 98 formed between the 0-ring gaskets 50 and 52.

During its closing, the valve assembly, by approaching the combustion chamber, causes a quantity of the air/fuel mixture in the passage 20 to flow towards the inside of the combustion chamber 14 The closing of the valve assembly thus makes it possible to increase the filling rate and thereby improve the efficiency of the engine.

The present invention can be used on all types of internal-combustion engine, for example four-stroke or two-stroke engines.

I claim:

1. Valve assembly (22) intended for closing a combustion chamber (14) of an internal-combustion engine and comprising a valve (36) and a valve seat (42), the valve lifting off from its seat in order to open the combustion chamber (14) by moving away from the latter, characterized in that the valve seat (42) is designed to move relative to the combustion chamber (14) under the effect of the pressure prevailing in this chamber and thereby to reinforce the closing of the valve assembly

2. Valve assembly according to claim 1, characterized in that the seat (42) is substantially annular and is mounted sealingly slidably in a bore (48) in the engine.

3. Valve assembly according to claim 2, characterized in that the seat (42) has means (50, 52, 58) for ensuring sealing between the seat (42) and the bore (48).

4. Valve assembly according to claim 3, characterized in that the means for ensuring sealing comprise two O-ring gaskets (50, 52) arranged on the periphery of the seat (42) and defining between them an annular space (98) designed to receive a cooling fluid.

5. Valve assembly according to one of claims 1 to 4, characterized in that the seat (42) has a chamfered surface intended for interacting sealingly with a corresponding surface (46) formed on the valve (36).

6. Valve assembly according to claim 1, characterized in that the seat (42) is mounted sealingly in a bore (48) made in the engine and is connected to this bore by means of a flexible element (100).

* * * * *